US012251597B2

(12) United States Patent
Castillo et al.

(10) Patent No.: US 12,251,597 B2
(45) Date of Patent: Mar. 18, 2025

(54) ACROBATIC EXERCISE ASSEMBLY

(71) Applicants: Teresa Castillo, Renton, WA (US); Daniel Tostado, Renton, WA (US)

(72) Inventors: Teresa Castillo, Renton, WA (US); Daniel Tostado, Renton, WA (US)

( * ) Notice: Subject to any disclaimer, the term of this patent is extended or adjusted under 35 U.S.C. 154(b) by 102 days.

(21) Appl. No.: 18/095,614

(22) Filed: Jan. 11, 2023

(65) Prior Publication Data

US 2024/0226647 A1 Jul. 11, 2024

(51) Int. Cl.

*A63B 21/00* (2006.01)
*A63B 1/00* (2006.01)
*A63B 71/02* (2006.01)

(52) U.S. Cl.

CPC ..... *A63B 21/4035* (2015.10); *A63B 1/00* (2013.01); *A63B 71/023* (2013.01)

(58) Field of Classification Search

CPC ..... A63B 21/4035; A63B 1/00; A63B 71/023; A63B 21/00047; A63B 21/00181; A63B 21/00185; A63B 21/068; A63B 21/1672; A63B 21/4033; A63B 21/4037; A63B 2210/50; A63B 23/0211; A63K 3/04–046

See application file for complete search history.

(56) References Cited

U.S. PATENT DOCUMENTS 2,705,162 A * 3/1955 Linsky ..... A63G 9/12 D8/382
2,763,455 A * 9/1956 Scaramucci ..... A63G 9/12 403/218
2,817,522 A * 12/1957 Margulies ..... A63B 17/00 482/145
2,977,118 A * 3/1961 Farkas ..... A63B 9/00 473/481
3,430,954 A 3/1969 Massey
3,483,999 A * 12/1969 Barrett ..... A47F 7/24 482/37
3,653,658 A * 4/1972 Robertson ..... A63B 3/00 482/25
3,944,219 A 3/1976 LoPresti
4,190,283 A * 2/1980 Boucher ..... A63G 9/12 403/65
4,256,300 A * 3/1981 Boucher ..... A63G 9/00 403/65

(Continued)

FOREIGN PATENT DOCUMENTS

CA 3074311 6/2017

*Primary Examiner* — Joshua Lee
*Assistant Examiner* — Catrina A Letterman

(57) ABSTRACT

An acrobatic exercise assembly includes a plurality of cross members which each has a unique structure with respect to each other. In this way each of the plurality of cross members can be gripped by a user in a different manner with respect to each other to facilitate the user to perform a variety of acrobatic maneuvers. A plurality of leg couplers is each coupled to a respective one of the plurality of cross members. A plurality of legs is provided and each of the plurality of legs is removably attachable to a respective one of the receivers on a respective one of the leg couplers that is coupled to a respective one of the cross members. In this way the respective cross member is elevated above a support surface to facilitate the user to suspend from the respective cross member to perform the acrobatic maneuvers.

1 Claim, 13 Drawing Sheets

(56) References Cited

U.S. PATENT DOCUMENTS 5,013,035 A * 5/1991 Nathaniel ..... A63B 23/03533 482/129
5,290,209 A * 3/1994 Wilkinson ..... A63B 21/00047 482/141
5,538,487 A 7/1996 Fulmer
5,582,565 A * 12/1996 Soria ..... A63B 21/00047 482/141
6,117,054 A * 9/2000 Soltanpour ..... A63B 69/0079 482/148
6,394,932 B1 * 5/2002 Chu ..... A63B 1/00 482/37
6,749,549 B1 * 6/2004 Chu ..... A63B 1/00 482/148
7,662,067 B2 * 2/2010 Payne ..... A63B 21/00047 482/141
7,832,574 B1 * 11/2010 Sexton ..... A47G 25/0664 211/195
8,033,960 B1 * 10/2011 Dalebout ..... A63B 23/03541 482/130
9,267,769 B1 * 2/2016 Gempler ..... B25H 1/06
9,675,829 B1 * 6/2017 Katz ..... A63B 17/02
10,532,239 B1 * 1/2020 Suarez Monne ..... A63B 17/04
10,874,896 B1 * 12/2020 Little ..... A63B 21/0442
11,045,687 B1 * 6/2021 Salomone ..... A63B 23/1218
D927,610 S 8/2021 Song
D955,522 S 6/2022 Song
11,426,619 B1 * 8/2022 Shane ..... A63B 23/1218
2004/0204292 A1 * 10/2004 Chu ..... A63B 71/023 482/41
2005/0130806 A1 * 6/2005 Lopez ..... A63B 21/00047 482/38
2007/0010375 A1 * 1/2007 Corte ..... A63B 1/00 482/41
2010/0012795 A1 * 1/2010 Spencer ..... A63G 31/00 248/440.1
2012/0322622 A1 12/2012 Davis
2015/0196119 A1 * 7/2015 Henniger ..... A63B 1/00 211/85.7
2017/0072260 A1 * 3/2017 Jackson ..... A63B 23/1218
2018/0021623 A1 * 1/2018 Brendle ..... A63B 21/065 482/38
2022/0379165 A1 * 12/2022 Alfandre ..... A63B 23/1218

* cited by examiner

ACROBATIC EXERCISE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to exercise devices and more particularly pertains to a new exercise device for facilitating a user to perform acrobatic maneuvers for exercise. The device includes a plurality of cross members that each has a unique structure with respect to each other. The device includes a plurality of leg couplers each attached to a respective cross member and a plurality of legs that are each attachable to a respective one of the leg couplers.

(2) Description of Related Art Including Information Disclosed Under 37 CFR 1.97 and 1.98

The prior art relates to exercise devices including an exercise stand that includes a pair of frames that are pivotally attached together which form a triangle and a pair of chains that retain the frames in the triangle. The prior art discloses an exercise frame which comprises a pair of A-frames and a pair of cross members that extend between the A-frames. The prior art discloses a plurality of exercise devices that each includes a central member extending between a pair of sets of legs that angle away from the central member for support the central member over a support surface.

BRIEF SUMMARY OF THE INVENTION

An embodiment of the disclosure meets the needs presented above by generally comprising a plurality of cross members which each has a unique structure with respect to each other. In this way each of the plurality of cross members can be gripped by a user in a different manner with respect to each other to facilitate the user to perform a variety of acrobatic maneuvers. A plurality of leg couplers is each coupled to a respective one of the plurality of cross members. A plurality of legs is provided and each of the plurality of legs is removably attachable to a respective one of the receivers on a respective one of the leg couplers that is coupled to a respective one of the cross members. In this way the respective cross member is elevated above a support surface to facilitate the user to suspend from the respective cross member to perform the acrobatic maneuvers.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
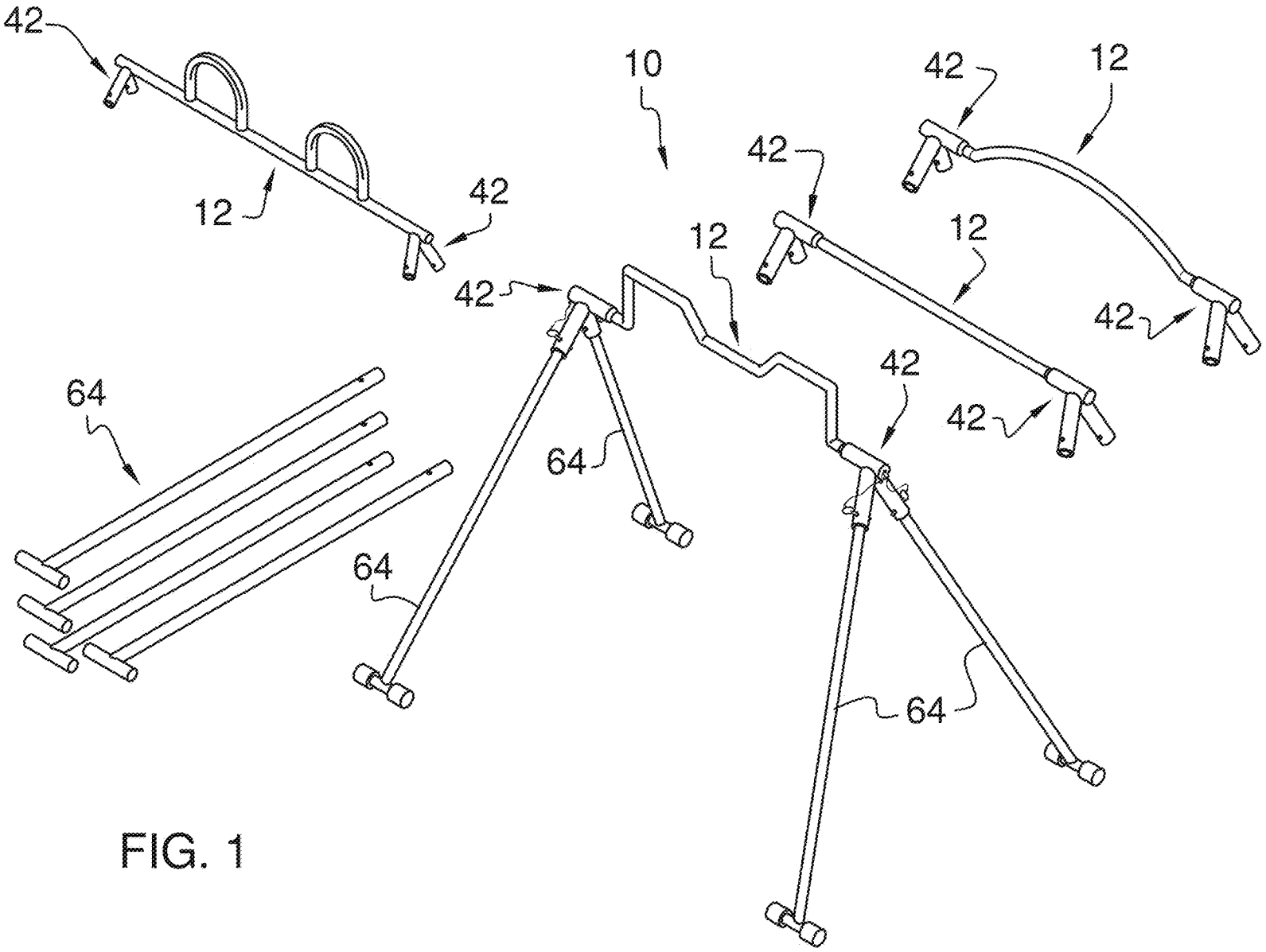
FIG. 1 is a perspective view of an acrobatic exercise assembly according to an embodiment of the disclosure.
Figure 2:
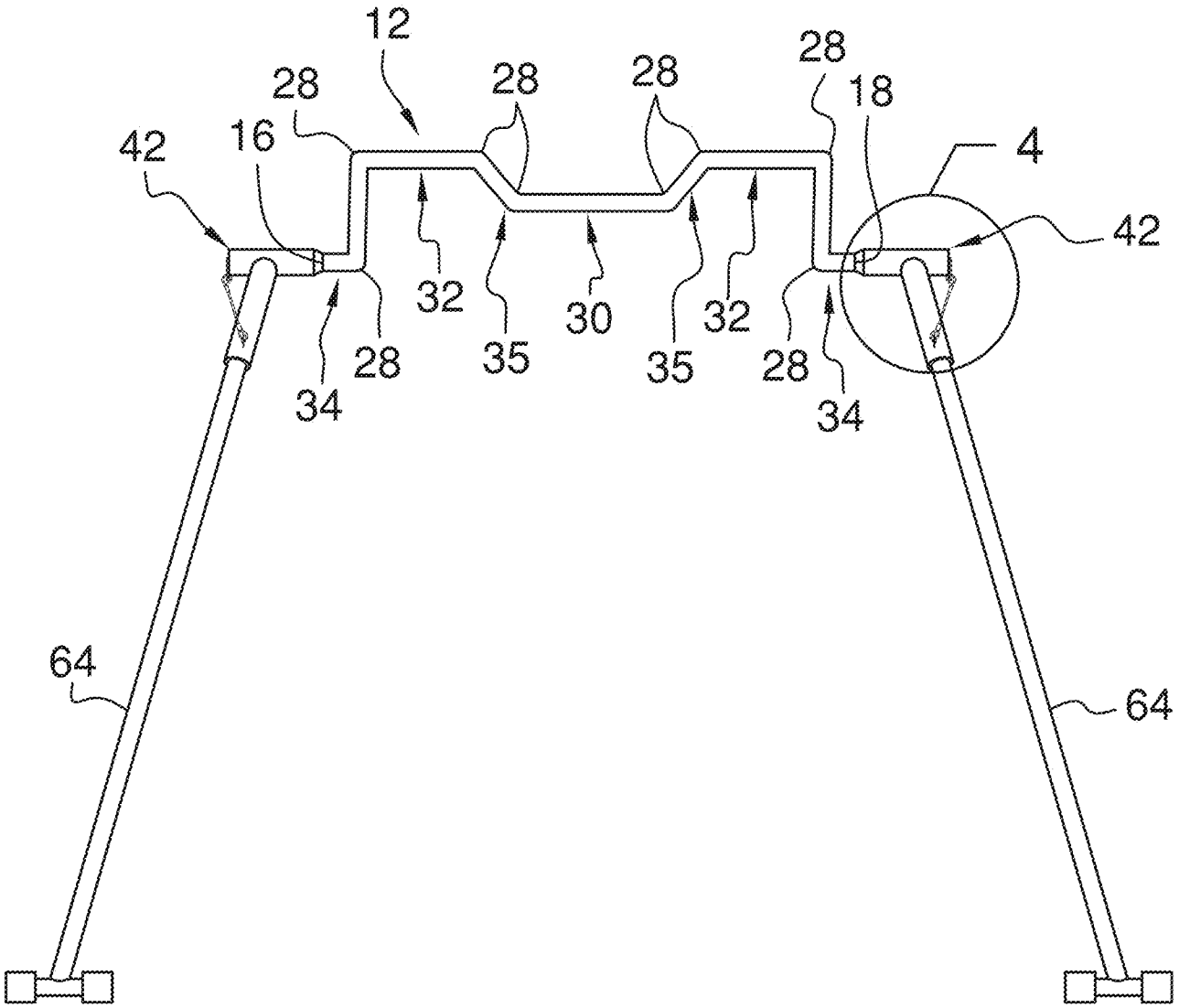
FIG. 2 is a front view of an embodiment of the disclosure showing a first cross member.
Figure 3:
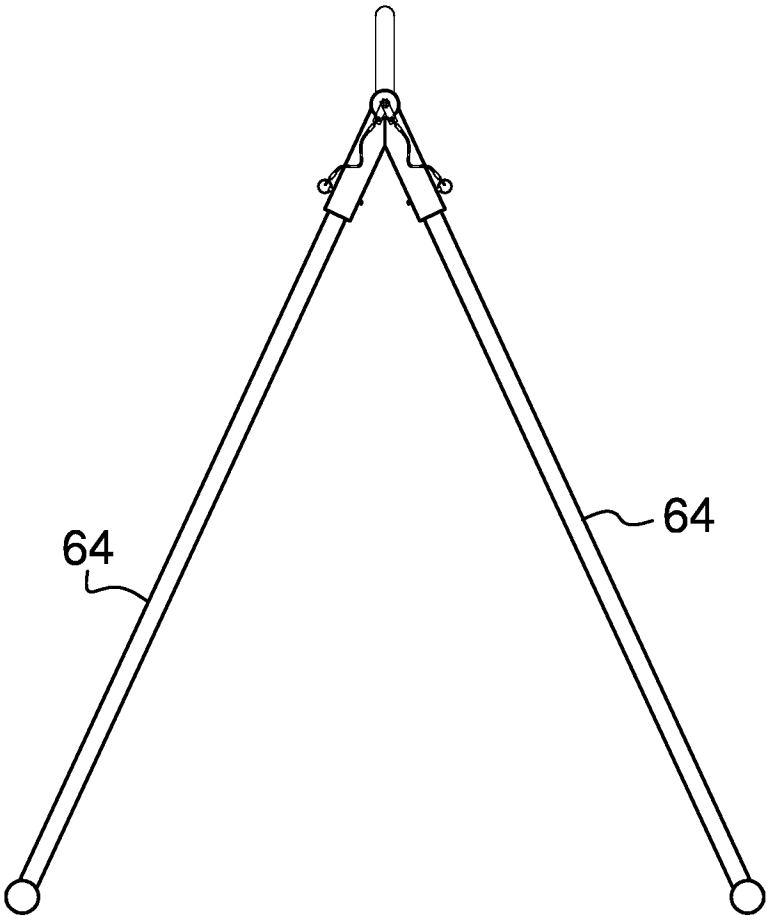
FIG. 3 is a left side view of an embodiment of the disclosure showing a first cross member.
Figure 4:
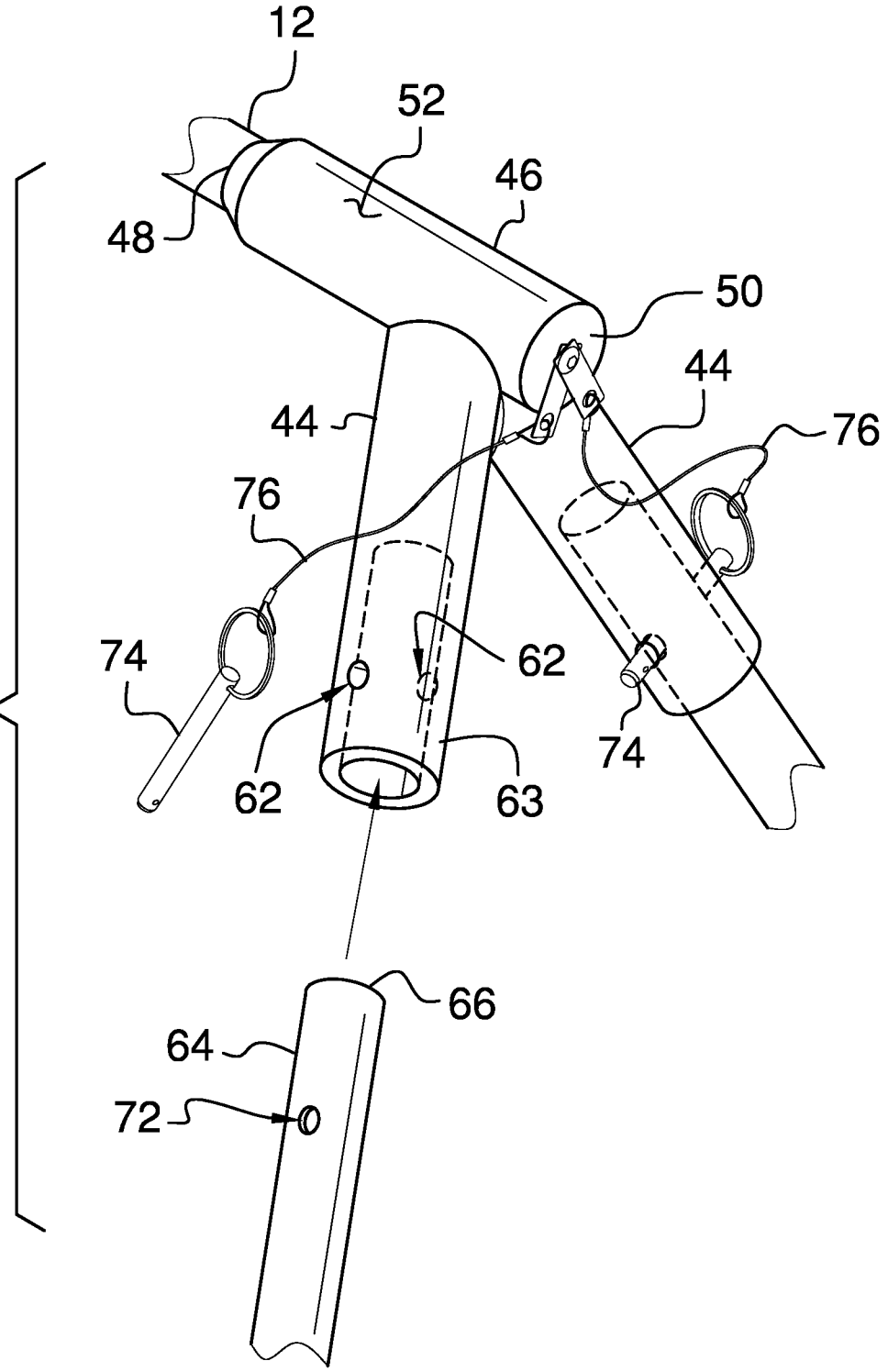
FIG. 4 is an exploded view taken from circle 4 of FIG. 2 of an embodiment of the disclosure.
Figure 5:
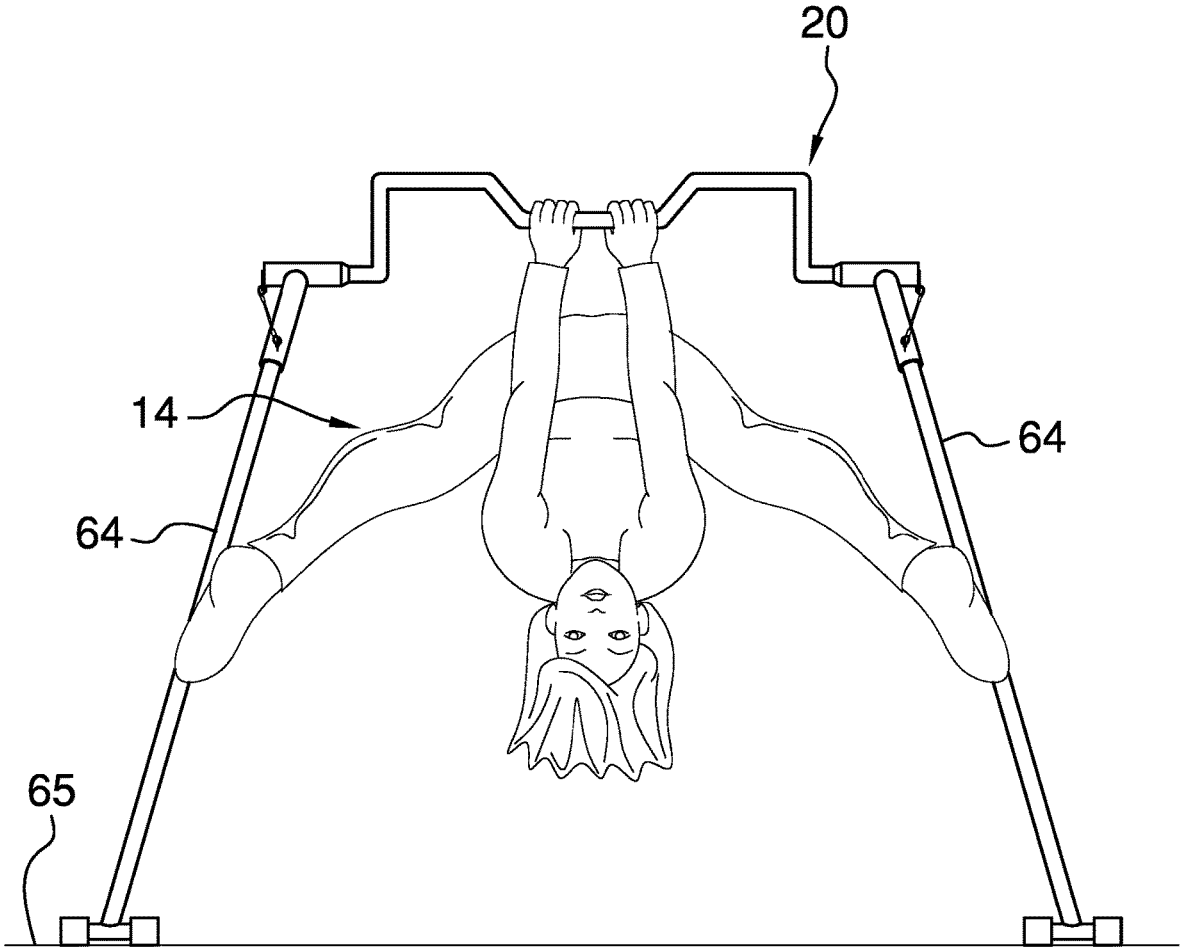
FIG. 5 is a perspective in-use view of an embodiment of the disclosure showing a user gripping a first cross member.
Figure 6:
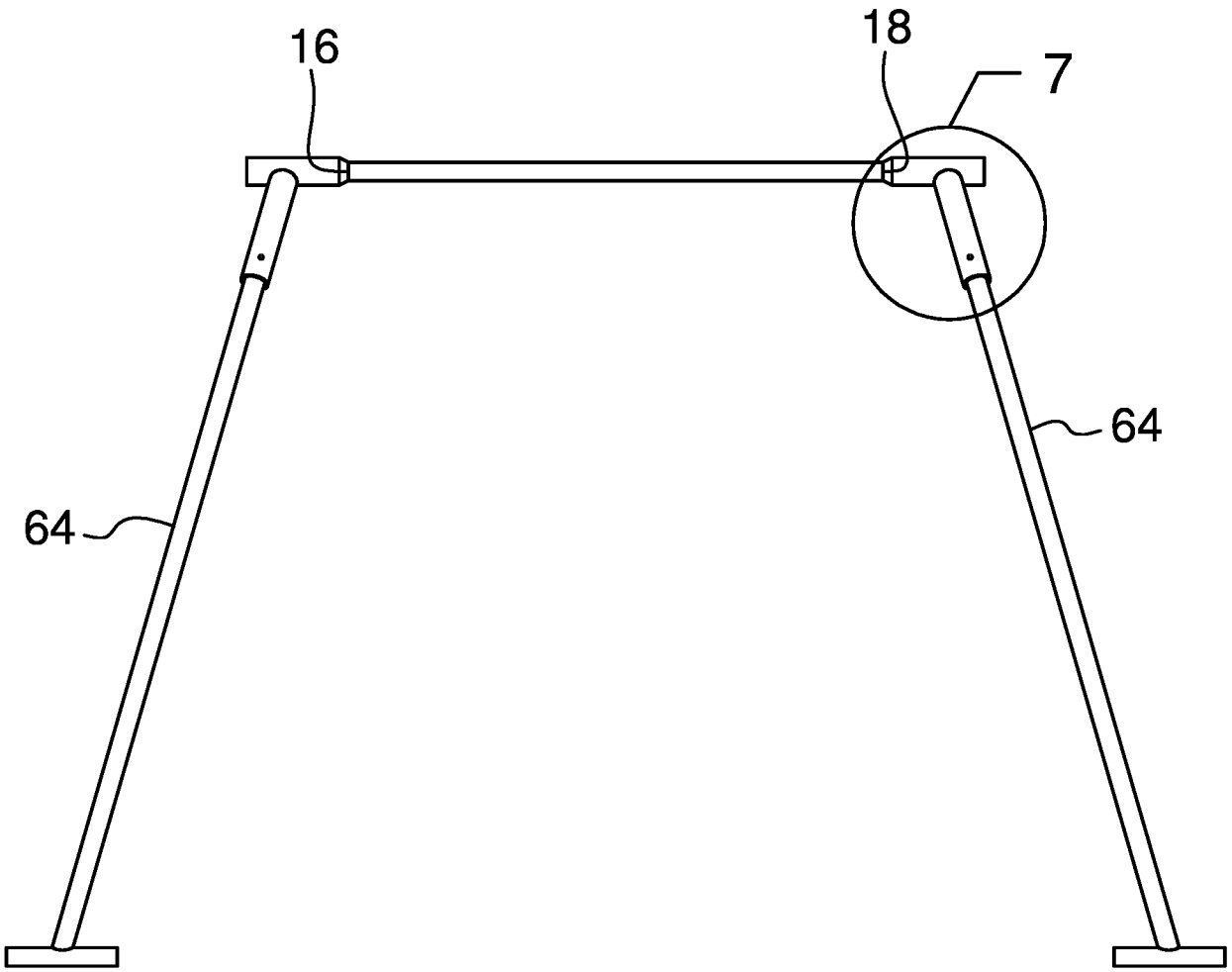
FIG. 6 is a front view of an embodiment of the disclosure showing a second cross member.
Figure 7:
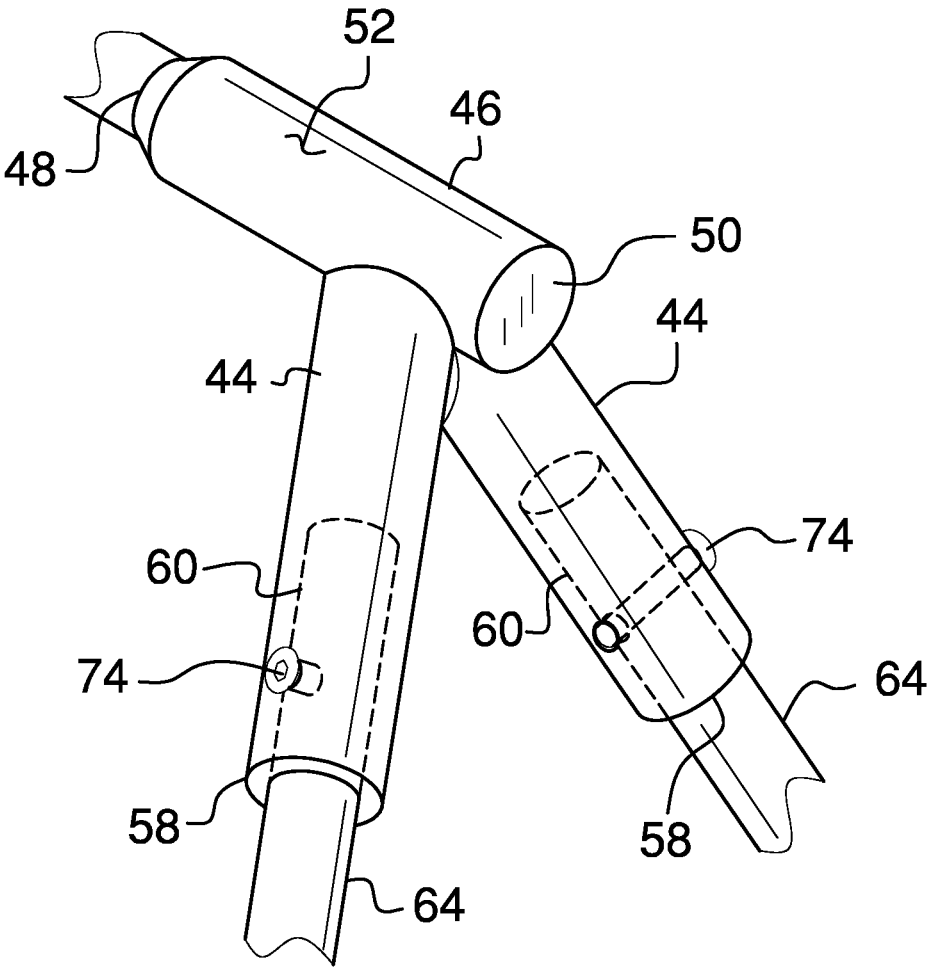
FIG. 7 is a phantom perspective view taken from circle 7 of FIG. 6 of an embodiment of the disclosure.
Figure 8:
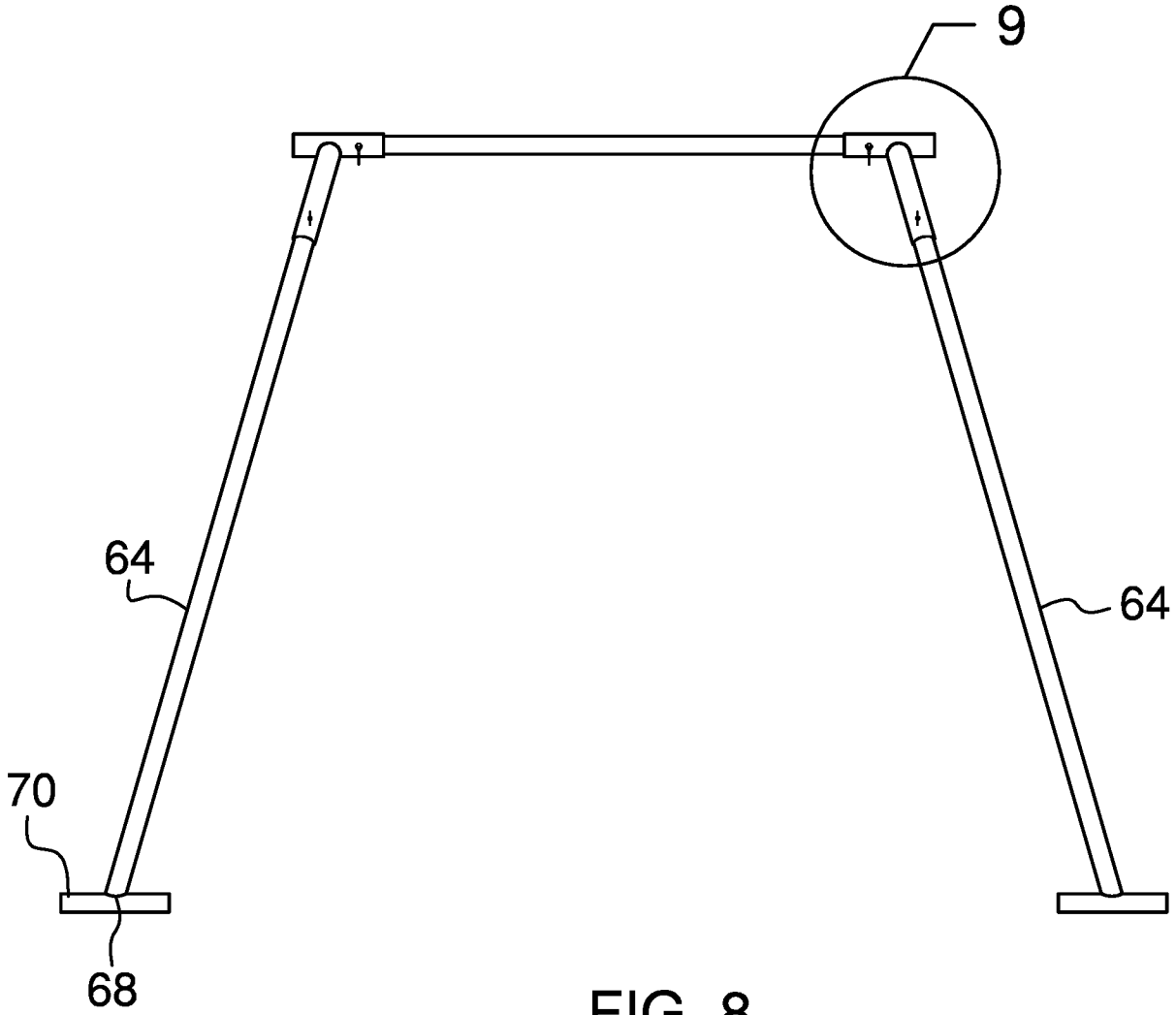
FIG. 8 is a front view of an embodiment of the disclosure showing a second member removably attached to pair of leg couplers.
Figure 9:
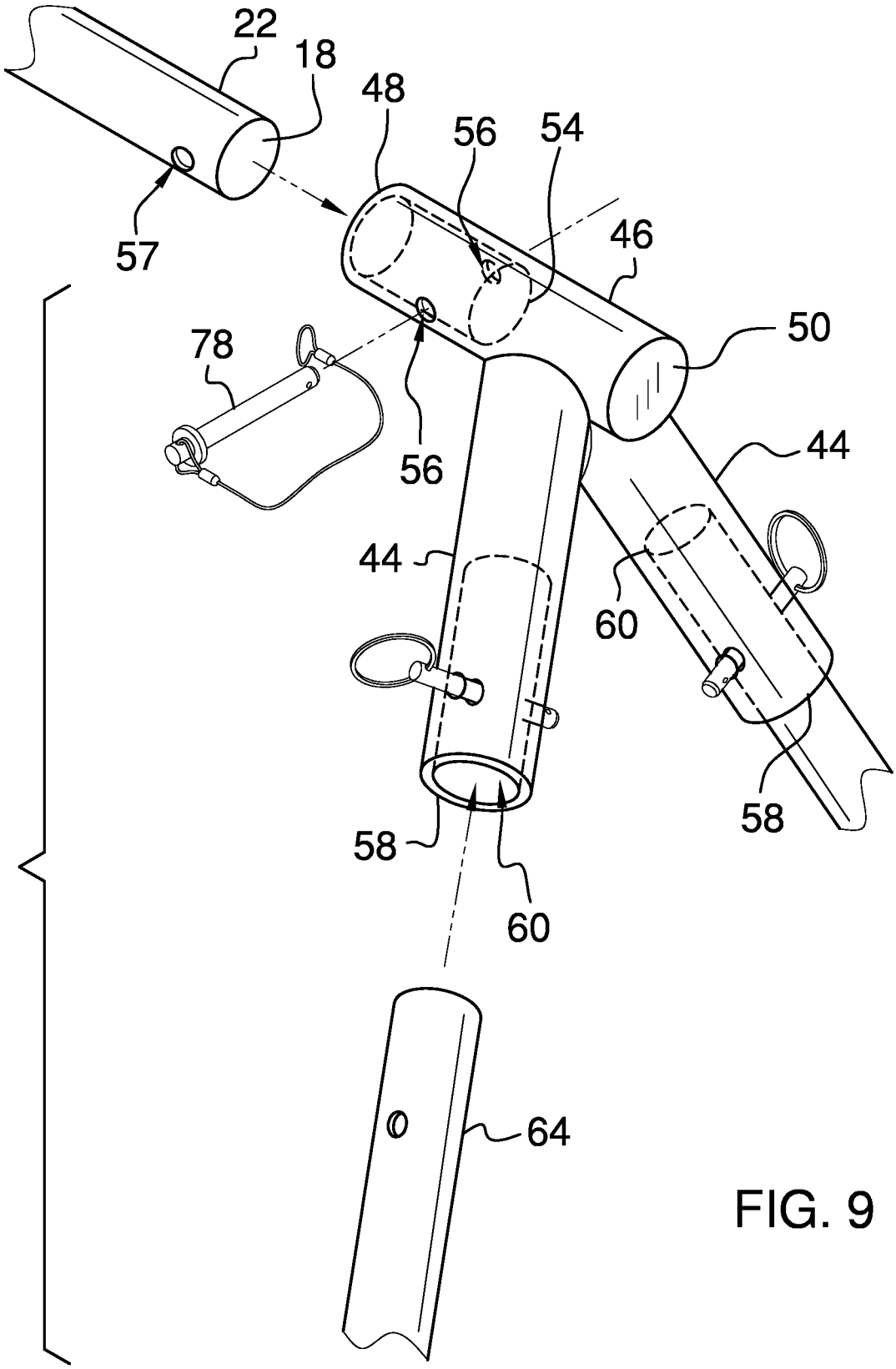
FIG. 9 is an exploded perspective view taken from circle 9 of FIG. 8 of an embodiment of the disclosure.
Figure 10:
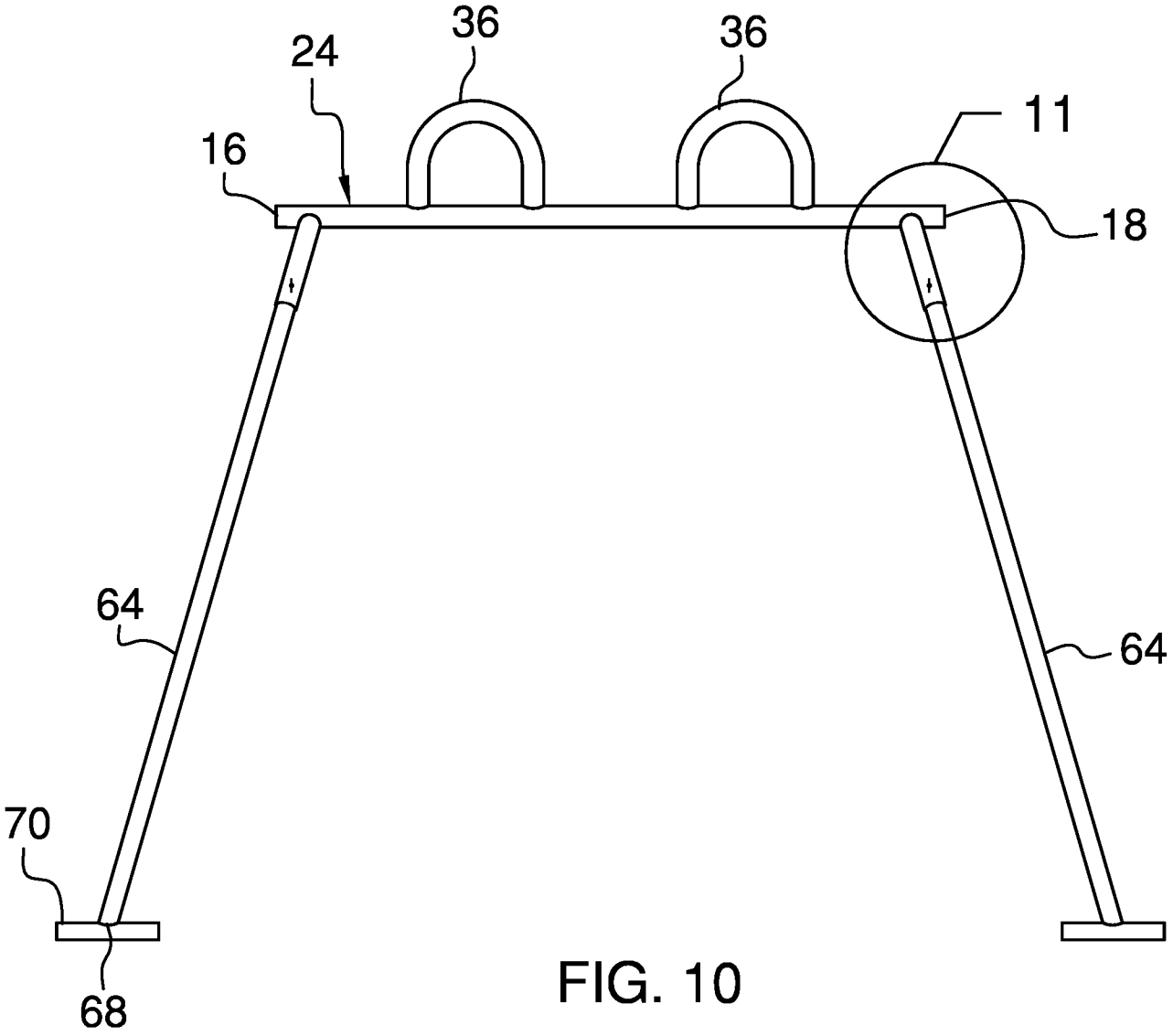
FIG. 10 is a front view of an embodiment of the disclosure showing a third cross member.
Figure 11:
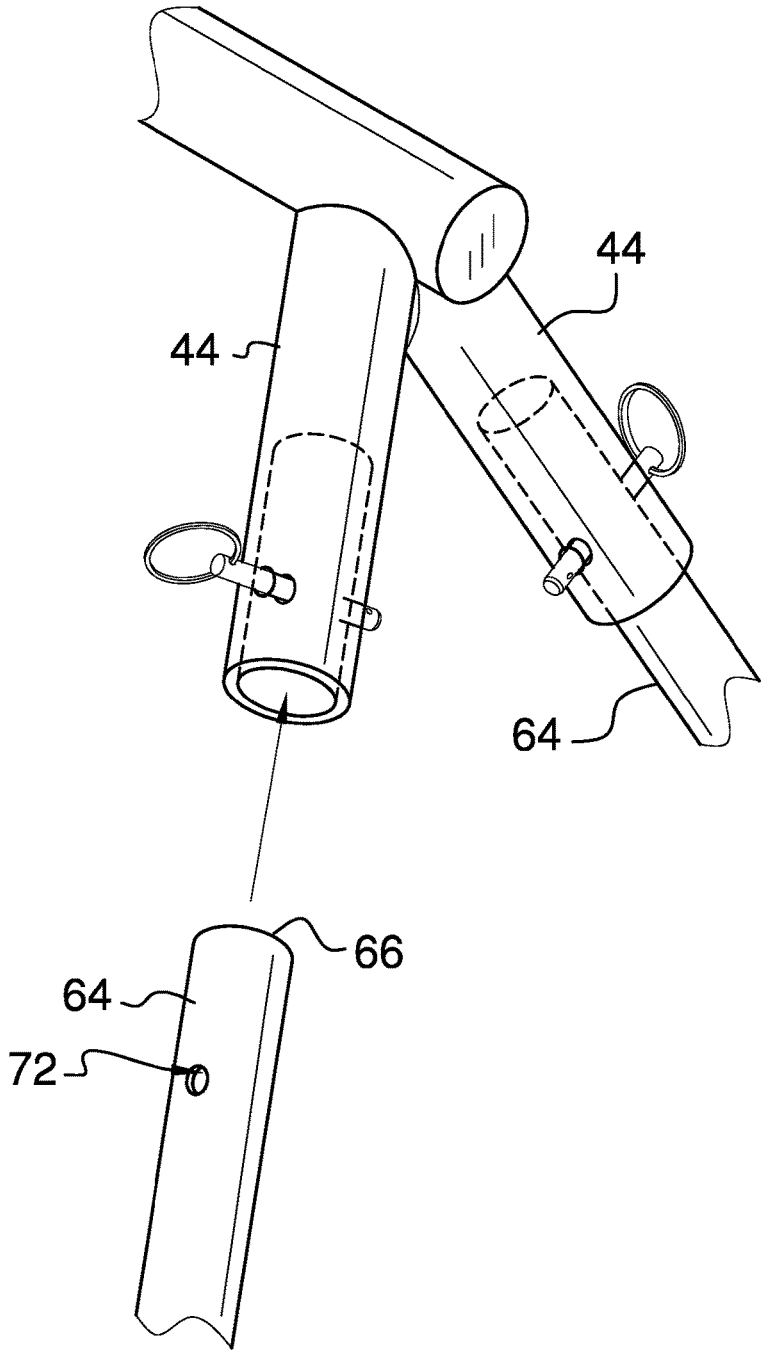
FIG. 11 is an exploded perspective view taken from circle 11 of FIG. 10 of an embodiment of the disclosure.
Figure 12:
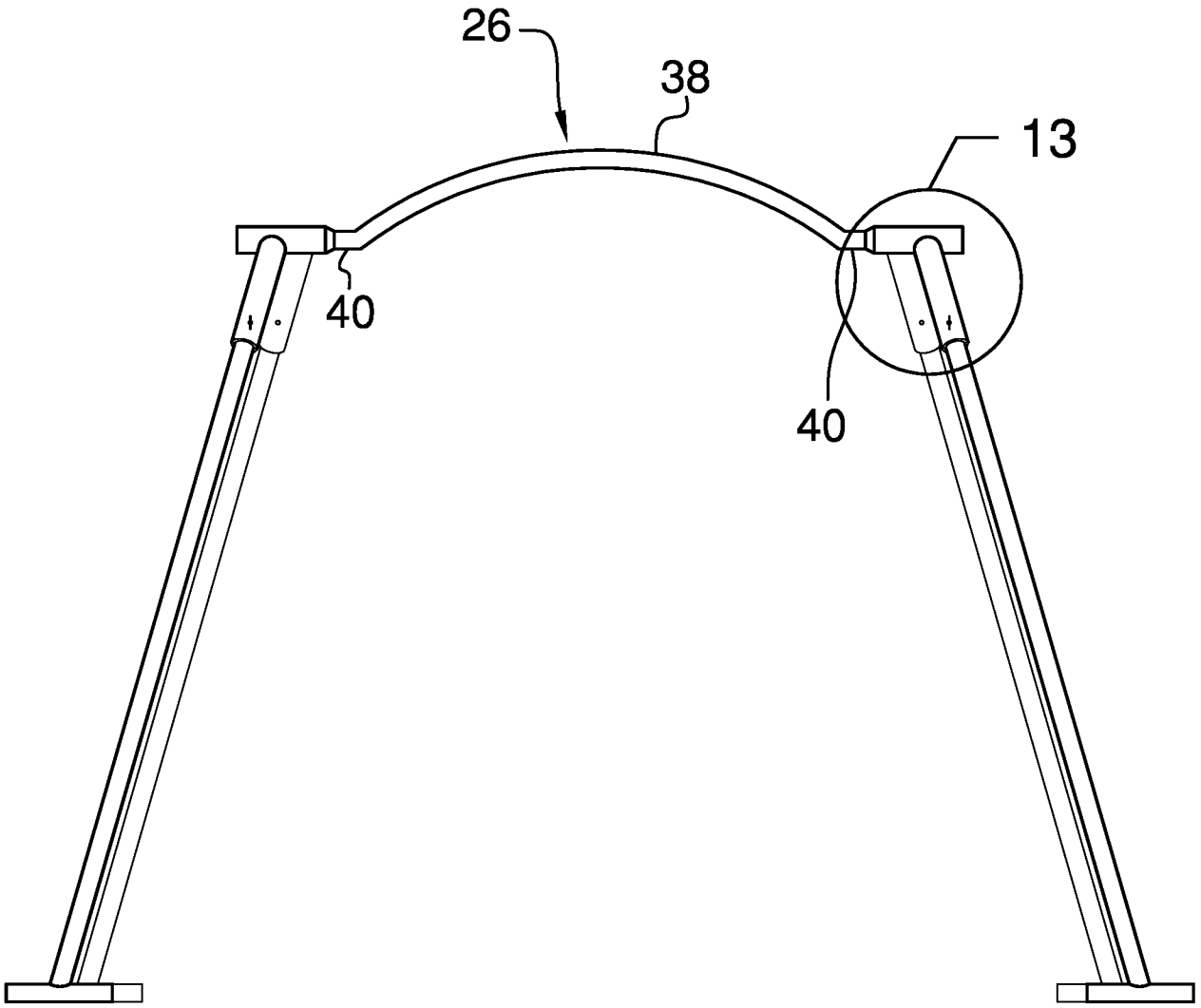
FIG. 12 is a front view of an embodiment of the disclosure showing a fourth cross member.
Figure 13:
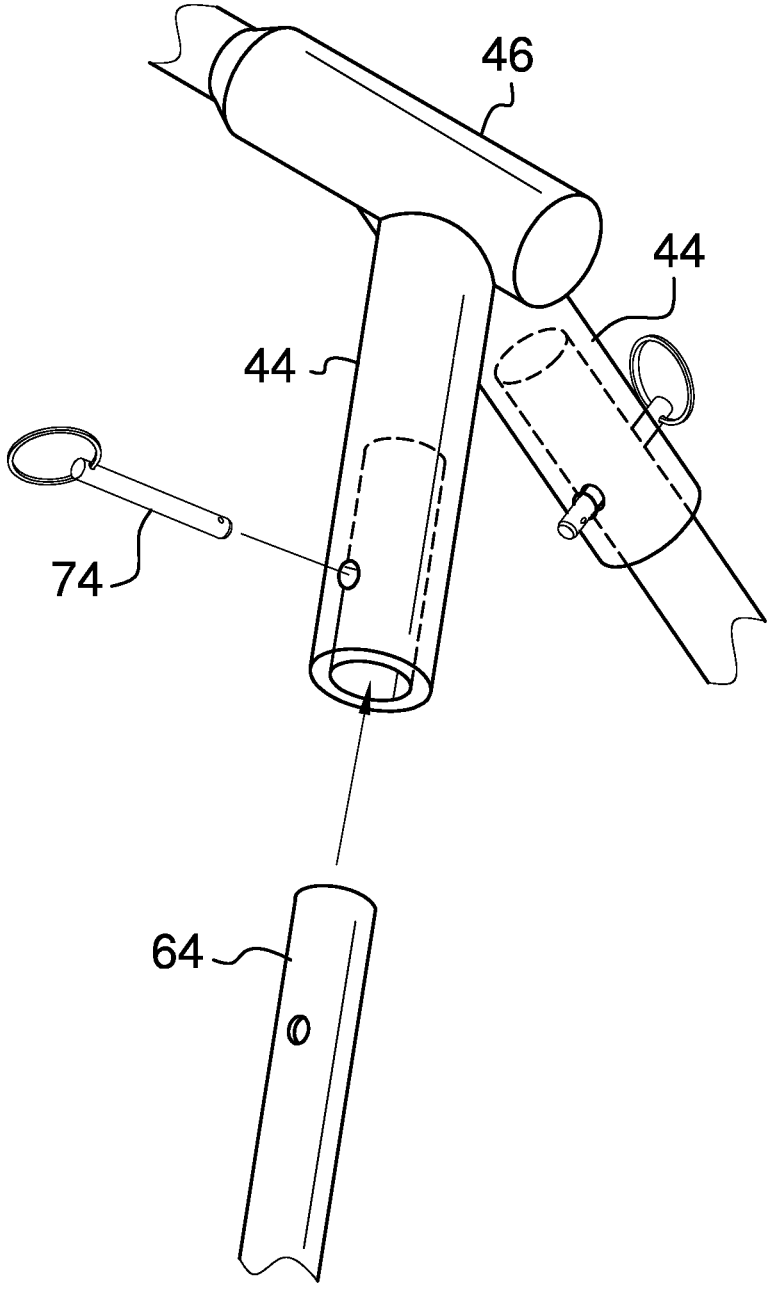
FIG. 13 is an exploded phantom view taken from circle 13 of FIG. 12 of an embodiment of the disclosure.

With reference now to the drawings, and in particular to FIGS. 1 through 13 thereof, a new exercise device embodying the principles and concepts of an embodiment of the disclosure and generally designated by the reference numeral 10 will be described.

As best illustrated in FIGS. 1 through 13, the acrobatic exercise assembly 10 generally comprises a plurality of cross members 12 that each has a unique structure with respect to each other thereby facilitating each of the plurality of cross members 12 to be gripped by a user 14 in a different manner with respect to each other. In this way each of the plurality of cross members 12 facilitates the user 14 to perform a variety of acrobatic maneuvers. Thus, the user 14 can employ the acrobatic maneuvers for the purposes of physical exercise. Each of the plurality of cross members 12 has a first end 16 and a second end 18; the plurality of cross members 12 includes a multi-level cross member 20, a straight cross member 22, a looped cross member 24 and a an arced cross member 26. Each of the plurality of cross members 12 may be powder coated or otherwise treated with a resilient coating for enhancing durability of the cross members 12 as well as enhancing the user's 14 ability to grip the cross members 12.

The multi-level cross member 20 has a series of bends 28 that are spaced apart from each other and are strategically distributed between the first end 16 and the second end 18 of the multi-level cross member 20. The bends 28 define a central grip 30 extending between a pair of outward grips 32 and a pair of end sections 34 thereby facilitating each of the outward grips 32 or the central grip 30 to be gripped by the user 14. Each of the end sections 34 is associated with a respective one of the first end 16 and the second end 18 of the multi-level cross member 20. Furthermore, each of the outward grips 32 extends along a line oriented parallel with the end sections 34 having the outward grips 32 being spaced upwardly from the end sections 34. The central grip 30 extends along a line that is oriented parallel with each of the outward grips 32 having the central grip 30 being spaced downwardly from the outward grips 32. The central grip 30 includes a pair of angled sections 35 which each angles between the central grip 30 and a respective one of the outward grips 32.

The straight cross member 22 is elongated between the first end 16 and the second end 18 associated with the straight cross member 22 such that the straight cross member 22 extends along a straight line thereby facilitating the straight cross member 22 to be gripped by the user 14. The looped cross member 24 is elongated between the first end 16 and the second end 18 associated with the looped cross member 24 such that the looped cross member 24 extends along a straight line. Additionally, the looped cross member 24 includes a pair of loops 36 that is each coupled to and curves upwardly from the looped cross member 24 thereby facilitating each of the loops 36 to be gripped by the user 14. Additionally, each of the loops 36 is spaced from a respective one of the first end 16 and the second end 18. The arced cross member 26 has a curved portion 38 that is centrally positioned between a pair of straightened portions 40. Each of the straightened portions 40 is associated with a respective one of the first end 16 and the second end 18 associated with the arced cross member 26, A plurality of leg couplers 42 is each coupled to a respective one of the plurality of cross members 12 and each of the leg couplers 42 has a pair of receivers 44 angling away from each other. Each of the leg couplers 42 comprises a cylinder 46 that has a primary end 48, a secondary end 50 and an outside surface 52 extending between the primary end 48 and the secondary end 50. Additionally, each of the receivers 44 associated with a respective one of the leg couplers 42 is coupled to and extends away from the outside surface 52 of the cylinder 46 associated with the respective leg coupler 42 at a point located adjacent to the secondary end 50 of the cylinder 46 associated with the respective leg coupler 42. Each of the receivers 44 associated with each of the leg couplers 42 angles away from each other; each of the receivers 44 associated with a respective one of the leg couplers 42 angles outwardly beyond the secondary end 50 of the cylinder 46 associated with the respective leg coupler 42.

The primary end 48 of the cylinder 46 associated with each of the leg couplers 42 is attached to a respective one of the first end 16 and the second end 18 of a respective one of the plurality of cross members 12. Each of the receivers 44 associated with each of the leg couplers 42 has a distal end 58 with respect to the cylinder 46 and the distal end 58 of each of the receivers 44 has a well 60 extending toward the cylinder 46. Each of the receivers 44 has a pair of holes 62 each extending through an outer wall 63 of the receiver 44 and intersecting the well 60. Each of the holes 62 associated with a respective receiver 44 is aligned with each other.

As is most clearly shown in FIGS. 1 through 7, the cylinder 46 associated with each of the leg couplers 42 has a diameter that is greater than a diameter of the respective cross member 12. Furthermore, the cylinder 46 associated with each of the leg couplers 42 is chamfered at the primary end 48. As is most clearly shown in FIGS. 8 and 9, the primary end 48 of the cylinder 46 associated with the leg couplers 42 which are associated with the straight cross member 22 has a cross member well 54 extending toward the secondary end 50 of the cylinder 46 associated with the leg couplers 42 which are associated with the straight cross member 22. Furthermore, each of the first end 16 and the second end 18 of the straight cross member 22 is insertable into the cross member well 54 associated with a respective one of the leg couplers 42. The cylinder 46 associated with the leg couplers 42 that are associated with the straight cross member 22 has a pair of pin holes 56 each extending into the cross member well 54. The straight cross member 22 has a pair of pin holes 57 each extending through the straight cross member 22 and each of the pin holes 56 in the straight cross member 22 are located adjacent to a respective one of the first end 16 and the second end 18 of the straight cross member 22. As is most clearly shown in FIGS. 10 and 11, the leg couplers 42 associated with the looped cross member 24 include only the receivers 44 which are each attached to and angle away from the looped cross member 24 at a point located adjacent to a respective one of the first end 16 and the second end 18 of the looped cross member 24.

A plurality of legs 64 is provided and each of the legs 64 is removably attachable to a respective one of the receivers 44 on a respective one of the leg couplers 42 that is coupled to a respective one of the cross members 12. In this way the respective cross member 12 is elevated above a support surface 65 to facilitate the user 14 to suspend from the respective cross member 12 to perform the acrobatic maneuvers. Each of the legs 64 has an upper end 66 and a lower end 68 and the upper end 66 of each of the legs 64 is insertable into the well 60 in the distal end 58 of a respective one of the receivers 44 associated with the respective leg coupler 42. Each of the legs 64 includes a foot 70 that is perpendicularly oriented with the lower end 68 thereby facilitating the foot 70 to lie on the support surface 65. Each of the legs 64 has a hole 72 extending laterally through the legs 64 and the hole 72 in each of the legs 64 is spaced from the upper end 66. The hole 72 in a respective leg 64 is aligned with each of the holes 62 in the outer wall 63 of the respective receiver 44 when the upper end 66 of the respective leg 64 is inserted into the well in the respective receiver.

A plurality of leg pins 74 is provided and each of the leg pins 74 is insertable through the holes 62 in the outer wall 63 of a respective receiver 44 of the respective leg coupler 42 and the hole 72 in the leg 64 that is inserted into the respective receiver 44 for retaining the leg 64 in the respective receiver 44. As is most clearly shown in FIG. 4, a pair of cables 76 may each be coupled to the secondary end 50 of each of the cylinders 46 of the leg couplers 42 associated with the multi-level cross member 20. Additionally, each of the leg pins 74 associated with the first cross member 20 is attached to a respective one of the cables 76. As is most clearly shown in FIG. 9, a cross member pin 78 is provided which is insertable through the pin holes 57 in cylinder 46 of a respective leg coupler 42 and a respective one of the pin holes 56 in the straight cross member 22 for retaining the respective leg coupler on the straight cross member 22.

In use, respective ones of the legs 64 are attached to respective leg couplers 42 on a respective one of the cross members 12 thereby elevating the respective cross member over the support surface 65. In this way the user 14 can grip the respective cross member for performing acrobatic maneuvers to increase the strength and flexibility of the user 14. In this way the user 14 can enjoy the benefits of physical exercise with a series of acrobatic maneuvers thereby increasing the number of options available to the user 14 during a workout. Furthermore, each of the multi-level cross member 20, the straight cross member 22, the looped cross member 24 and the arced cross member 26 can be elevated on respective legs 64 to facilitate the user 14 to employ the multi-level cross member 20, the straight cross member 22, the looped cross member 24 and the arced cross member 26 in a circuit.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An acrobatic exercise assembly for facilitating a user to practice acrobatic maneuvers for the purposes of physical exercise, said acrobatic exercise assembly comprising:

a plurality of cross members, each of said plurality of cross members having a unique structure with respect to each other thereby facilitating each of said plurality of cross members to be gripped by a user in a different manner with respect to each other wherein each of said plurality of cross members is configured to facilitate the user to perform a variety of acrobatic maneuvers, each of said plurality of cross members having a first end and a second end, said plurality of cross members including:

a multi-level cross member, said multi-level cross member having a series of bends being spaced apart from each other and being distributed between said first end and said second end of said first multi-level cross member to define a central grip extending between a pair of outward grips and a pair of end sections, each of said pair of end sections being associated with a respective one of said first end and said second end of said multi-level cross member, each of said pair of outward grips extending along a line oriented parallel with said pair of end sections having said pair of outward grips being spaced upwardly from said pair of end sections, said central grip extending along a line being oriented parallel with each of said pair of outward grips having said central grip being spaced downwardly from said pair of outward grips, said central grip including a pair of angled sections each angling between said central grip and a respective one of said pair of outward grips;

a straight cross member, said straight cross member being elongated between said first end and said second end associated with said straight cross member such that said straight cross member extends along a straight line thereby facilitating said straight cross member to be gripped by the user;

a looped handle cross member, said looped handle cross member having a cross portion which is elongated between said first end and said second end associated with said looped handle cross member such that said cross portion extends along a straight line, said looped handle cross member including a pair of loops each being coupled to and curving upwardly from said cross portion thereby facilitating each of said pair of loops to be gripped by the user, each of said pair of loops being spaced from a respective one of said first end and said second end of said looped handle cross member, said pair of loops being fixed with respect to said cross portion, said pair of loops lying on a shared plane; and an arced cross member, said arced cross member having a curved portion being centrally positioned between a pair of straightened portions, each of said pair of straightened portions being associated with a respective one of said first end and said second end associated with said arced cross member;

a plurality of leg couplers, each of said plurality of leg couplers being interchangeably couplable to each of said plurality of cross members, each of said plurality of leg couplers having a pair of receivers angling away from each other, each of said plurality of leg couplers comprising a cylinder having a primary end, a secondary end and an outside surface extending between said primary end and said secondary end, each of said pair of receivers associated with a respective one of said plurality of leg couplers being coupled to and extending away from said outside surface of said cylinder associated with said respective leg coupler at a point located adjacent to said secondary end of said cylinder associated with said respective leg coupler, each of said pair of receivers associated with each of said plurality of leg couplers angling away from each other, each of said pair of receivers associated with a respective one of said plurality of leg couplers angling outwardly beyond said secondary end of said cylinder associated with said respective leg coupler, each of said pair of receivers associated with each of said plurality of leg couplers having a distal end with respect to said cylinder, said distal end of each of said pair of receivers having a well extending toward said cylinder, each of said pair of receivers having a pair of holes each extending through an outer wall of said receiver and intersecting said well, each of said pair of holes associated with a respective receiver being aligned with each other, said primary end of said cylinder associated with each of said plurality of leg couplers being attached to a respective one of said first end and said second end of a respective one of said plurality of cross members;

a plurality of legs, each of said plurality of legs being removably attachable to a respective one of said pair of receivers on a respective one of said plurality of leg couplers that is coupled to a respective one of said plurality of cross members thereby facilitating said respective cross member to be elevated above a support surface to facilitate the user to suspend from said respective cross member to perform the acrobatic maneuvers, each of said plurality of legs having an upper end and a lower end, said upper end of each of said plurality of legs being insertable into said well in said distal end of a respective one of said pair of receivers associated with said respective leg coupler, each of said plurality of legs including a foot being perpendicularly oriented with said lower end thereby facilitating said foot to lie on the support surface, each of said plurality of legs having a hole extending laterally through said plurality of legs, said hole in each of said plurality of legs being spaced from said upper end, said hole in a respective leg being aligned with each of said pair of holes in said outer wall of said respective receiver when said upper end of said respective leg is inserted into said well in said respective receiver; and a plurality of leg pins, each of said plurality of leg pins being insertable through said pair of holes in said outer wall of a respective receiver of said respective leg coupler and said hole in said leg that is inserted into said respective receiver for retaining said leg in said respective receiver.

* * * * *